US006617810B2

(12) United States Patent
Symons

(10) Patent No.: US 6,617,810 B2
(45) Date of Patent: Sep. 9, 2003

(54) MULTI-STAGE CAVITY CYCLOTRON RESONANCE ACCELERATORS

(75) Inventor: Robert Spencer Symons, Los Altos, CA (US)

(73) Assignee: L-3 Communications Corporation, San Carlos, CA (US)

( * ) Notice: Subject to any disclaimer, the term of this patent is extended or adjusted under 35 U.S.C. 154(b) by 0 days.

(21) Appl. No.: 09/797,434

(22) Filed: Mar. 1, 2001

(65) Prior Publication Data

US 2003/0141448 A1 Jul. 31, 2003

Related U.S. Application Data

(60) Provisional application No. 60/186,562, filed on Mar. 1, 2000.

(51) Int. Cl.[7] ..... H05H 3/00; H05H 15/00

(52) U.S. Cl. ..... 315/500; 315/502; 315/505; 250/292; 250/423 R

(58) Field of Search ..... 250/290, 292, 250/423 R; 315/500, 501, 502, 504, 505

(56) References Cited

U.S. PATENT DOCUMENTS 4,959,543 A * 9/1990 McIver, Jr. et al. ..... 250/291

OTHER PUBLICATIONS

By Changbiao Wang and J.L. Hitshfield "Energy Limit in Cyclotron Autoresonance Acceleration" 1995 The American Physical Society, Physical Review E, vol. 51, No. 3, Mar. 1995, p. 2456–2464.

By H.R. Jory and A. W. Trivelpiece "Charged–Particle Motion in Large–Amplitude Electromagnetic Fields" Jun. 1968, Journal of Applied Physics, vol. 10, No. 7, p. 3053–3060.

By R.M. Hutcheon, L.D. Hansborough, K.J. Hohban and S.O. Schriber; RFQ Linac Structure Developments At CRNL 1983 IEEE Transactions on Nuclear Science, vol. NS–30, No. 4, Aug. 1983; Atomic Energy of Canada Limited, Research Company, Chalk River Nuclear Laboratories, Chalk River, Ontario, Canada; XP–001042071; PD: Mar. 21, 1983; pp. 3521–3523.

(List continued on next page.)

*Primary Examiner*—John R. Lee
*Assistant Examiner*—Paul M. Gurzo
(74) *Attorney, Agent, or Firm*—O'Melveny & Myers LLP

(57) ABSTRACT

A high-current, high-gradient, high-efficiency, multi-stage cavity cyclotron resonance accelerator (MCCRA) provides energy gains of over 50 MeV/stage, at an acceleration gradient that exceeds 20 MeV/m, in room temperature cavities. The multi-stage cavity cyclotron resonance accelerator includes a charged particle source, a plurality of end-to-end rotating mode room-temperature cavities, and a solenoid coil. The solenoid coil encompasses the cavities and provides a substantially uniform magnetic field that threads through the cavities. Specifically, the MCCRA is provided with a constant magnetic field sufficient to produce a cyclotron frequency a little higher than the RF of the accelerating electric field. A plurality of input feeds, each of which respectively coupled to a cavity, are also provided. According to an embodiment of the invention, the beam from the first cavity passes through a cutoff drift tube and is accelerated further with a cavity supporting a still lower radio-frequency electric field. This embodiment yields a several-milliampere one-gigavolt proton beam efficiently. The single cavity transfers about 70% of the radio-frequency energy to the beam. A multiple-cavity accelerator using a constant or slightly decreasing static magnetic field along its length and using cutoff drift tubes between the cavities operating at progressively lower frequencies, each somewhat lower than the local relativistic cyclotron frequency of the beam in that cavity, provides an extremely-efficient, compact, continuously-operating, medium-energy accelerator.

20 Claims, 5 Drawing Sheets

MULTI–CAVITY CYCLOTRON RESONANCE ACCELERATOR

OTHER PUBLICATIONS

By Changbiao Wang and J.L. Hirshfield, Multistage Cyclotron Autoresonance Accelerator Jun. 1998 Physical Review E, vol. 57, No. 6; Physics Department, Yale University, New Haven, Connecticut and Omega P Incorporated, Yale Station, New Haven, Connecticut, (Received Sep. 24, 1997; revised manuscript received Feb. 19, 1998); PD: 00–00–1998; pp. 7184–7191.

By J.L. Hirshfield, Changbiao Wang and Robert Symons, Multi–Stage, High–Gradient, Cyclotron Resonance Proton Accelerator Concept XP–001059769; Beam Physics Laboratory, Yale Univ. New Haven, CT, Omega–P, Inc. New Haven, CT, Litton Electron Devices Division, San Carlos, CA; CP569, Advanced Accelerator Concepts; 2001 American Institute of Physics 0–7354–0005–9/01; PD–10–6–2000; pp. 833–843.

By Luis Ugozzoli and R. Bruce Wallace, Application of an Allele–Specific Polymerase Chain Reaction to the Direct Determination of ABO Blood Group Genotypes XP–008000234; Genomics 12,670–674 (1992); Department of Molecular Biochemistry, Beckman Research Institute of the City of Hope, 1450 East Duarte Road, California; Received Jun. 6, 1991; revised Nov. 4, 1991; PD–04/1992; pp. 670–674.

* cited by examiner

MULTI-STAGE CAVITY CYCLOTRON RESONANCE ACCELERATORS

CROSS-REFERENCE TO RELATED APPLICATION

This application claims the benefit of U.S. Provisional Application Serial No. 60/186,562, filed Mar. 1, 2000, pursuant to 35 U.S.C. §119(e), which application is specifically incorporated by reference herein.

BACKGROUND OF THE INVENTION

1. Field of the Invention

The present invention relates to charged particle accelerators, and more particularly, to a cyclotron resonance accelerator having multiple cavity stages with a uniform magnetic field across each stage in order to provide substantially increased efficiency.

2. Description of Related Art

There are several applications for charged particle accelerators that will produce particles with energies equal to about two or three times their rest mass energy. For example, electrons (rest mass equivalent to 511,000 volts) when accelerated with 1 million volts produce X-rays which have the right energy for determining the density of rock, a property important in determining whether or not the rock is porous enough to contain oil. One to several million electron volts is also the right energy for X-rays used in food sterilization to insure against e. coli, salmonella, and listeria contamination. Protons (rest mass equivalent to 943,000,000 volts) when accelerated to about one billion volts have a large cross section for the production of neutrons when they collide with the nuclei of heavy metals such as lead, mercury, or tungsten. These neutrons are capable of driving sub-critical reactors. Such sub-critical reactors use fissile nuclear fuel more efficiently, consume long-lived actinides and hence reduce the geologic storage problem relative to that of waste from conventional nuclear reactors. In none of these accelerator applications is it important that the beam of particles be focused on a small spot as is the case for imaging X-ray tubes. In these applications a diffuse impact zone is an advantage because it helps solve an otherwise difficult thermal problem.

In high-energy machines, linear acceleration is useful because it eliminates losses due to synchrotron radiation. In high-current machines, linear accelerators are useful because the loading of the beam on each cavity can be large compared to the losses in the cavity due to electrical resistance of the cavity material. This is particularly true for pulsed machines in which cavity losses are minimized by turning off the RF power between high-current beam pulses. In continuous-current machines, in which a requirement for a low-emittance, well-focused beam exists, the beam loading is so small that super-conducting cavities have had to be used to solve the cavity loss problem. Otherwise, circular machines in which the beam orbits in the same cavity many times are much more efficient because the beam loading is increased, relative to the losses, roughly in proportion to the number of times the beam passes through the cavity. The problem with circular machines is that the cyclotron frequency changes as the relativistic mass of the particle changes with energy. In general, a particle is accelerated as long as the frequency of the accelerating voltage is below the relativistic cyclotron frequency of the particle in the magnetic field. As the particle gains energy, the relativistic cyclotron frequency falls below the frequency of the "accelerating" voltage and the particle gives some of its energy back to the "accelerating" electric field.

In 1945, Veksler in the U.S.S.R. and McMillan in this country pointed out that relativistic particles tend to"bunch" and remain stable with respect to the phase of the accelerating voltage. Thus, the limitation on energy imposed by the change in cyclotron frequency with energy in a conventional cyclotron can be dealt with by changing either the frequency of the accelerating voltage or the magnetic field as is done in the synchro-cyclotron or the synchrotron, respectively. If these changes are made slowly enough, charged particles gain energy as the frequency is lowered or the magnetic field is raised. Such beams are not continuous, but instead are extracted from the device after the desired energy level has been reached.

In 1958 and 1959, Twiss, Gaponov, and Schneider recognized that electrons traveling along helical paths in a transverse RF electric field and a steady axial magnetic field could be bunched azimuthally through the mechanism of the relativistic mass change. They could also radiate at a frequency near the cyclotron frequency. This interaction is now sometimes called the "cyclotron resonance maser" (CRM) instability. Hirshfield and Wachtel at Yale both observed the CRM instability and calculated its characteristics. It is probably correct to think of the CRM instability as the inverse of synchrotron acceleration with the addition of axial motion to the electrons. Jory and Trivelpiece accelerated electrons with 1,000 volts of energy traveling along the axis of a $TE_{111}$ circular waveguide cavity to 500,000 volts of energy with momentum directed primarily in the circumferential direction. They used these electrons to generate millimeter wavelength radiation in another circular waveguide supporting a higher order mode.

More recently, Hirshfield has built more sophisticated inverse CRM accelerators. He built an electron accelerator similar to the device described above except that the magnetic field increased along the axis of a waveguide supporting a $TE_{11}$, mode so that the Doppler shifted RF electric field maintained synchronism with the relativistic cyclotron frequency. This kind of device is called a Cyclotron Auto-Resonance Accelerator (CARA). Hirshfield developed the computer codes necessary to simulate the motion of charged particles in static magnetic and high-frequency electromagnetic fields. Hirshfield first tried a CARA for electrons. The results showed that an energy equal to twice the rest mass energy could be reached with achievable field strengths, but the efficiency was not impressive. Simulations for protons were very disappointing. The proton particles made very few orbits in the magnetic field before mirroring occurred. Because the axial magnetic field in a CARA increases with axial distance, there must be a radial magnetic field. This interacts with the angular velocity of the particles, eventually stops the beam, and sends it back along the axis. For the CARA for protons, it turned out that unless the electric field in the cavity and the consequent losses are very high, the protons stopped before making enough orbits to gain anything close to the desired energy.

Accordingly, it would be advantageous to provide an accelerator capable of accelerating a particle to an energy equal to at least twice its rest mass with high efficiency, without the stalling problem of known cyclotron auto-resonance accelerators.

SUMMARY OF THE INVENTION

In accordance with the teachings of the present invention, a high-current, high-gradient, high-efficiency, multi-stage cavity cyclotron resonance accelerator (MCCRA) provides energy gains of over 50 MeV/stage, at an acceleration gradient that exceeds 20 MeV/m, in room temperature cavities.

The multi-stage cavity cyclotron resonance accelerator includes a charged particle source, a plurality of end-to-end rotating mode room-temperature cavities, and a solenoid coil. The solenoid coil encompasses the cavities and provides a substantially uniform magnetic field that threads through the cavities. Specifically, the MCCRA is provided with a constant magnetic field sufficient to produce a cyclotron frequency a little higher than the RF of the accelerating electric field. A plurality of input feeds, each of which are respectively coupled to a cavity, are also provided. According to an embodiment of the invention, the beam from the first cavity passes through a cutoff drift tube and is accelerated further with a cavity supporting a still lower radio-frequency electric field. This embodiment yields a several-milliampere one-gigavolt proton beam efficiently. The single cavity transfers about 70% of the radio-frequency energy to the beam. A multiple-cavity accelerator using a constant or slightly decreasing static magnetic field along its length and using cutoff drift tubes between the cavities operating at progressively lower frequencies, each somewhat lower than the local relativistic cyclotron frequency of the beam in that cavity, provides an extremely-efficient, compact, continuously-operating, medium-energy accelerator.

The magnetic field in the accelerator is substantially uniform across all stages, since an increasing field would lead to undesirable loss of axial momentum and stalling, while a decreasing field would lead to an unmanageable increase in orbit radius. Successive cavity stages of the accelerator will operate at successively-lower RF frequencies to maintain approximate resonance as the particle mass increases.

In an alternative embodiment, the cavity diameters are reduced by using dielectric loading in the form of a thick coaxial dielectric liner. In yet another alternative embodiment, thick radial vanes are employed in the cavity that provide capacitive loading and thereby reduce the cutoff frequency for the desired dipole modes. When four symmetric vanes are used, the structure resembles that for a radio-frequency quadrupole (RFQ), except that it is the two degenerate dipole modes that are of interest rather than the quadrupole modes. To obtain a rotating (i.e., circularly polarized) field, these two dipole modes are excited in time-quadrature. The structure can be labeled a radio-frequency double-dipole (RFDD).

A more complete understanding of the multi-stage cavity cyclotron resonance accelerator (MCCRA) will be afforded to those skilled in the art, as well as a realization of additional advantages and objects thereof, by a consideration of the following detailed description of the preferred embodiment. Reference will be made to the appended sheets of drawing which will first be described briefly.

DESCRIPTION OF THE PREFERRED EMBODIMENT

The present invention is directed to a high-current, high-gradient, high-efficiency, multi-stage cavity cyclotron resonance accelerator (MCCRA). The MCCRA provides energy gains of over 50 MeV/stage, at an acceleration gradient that exceeds 20 MeV/m, in room temperature cavities. Accelerated currents of over 100 mA can be obtained over a full multi-microsecond pulse, free of microbunches. Acceleration is provided via cyclotron resonance, so a strong static magnetic field is required.

Figure 1:
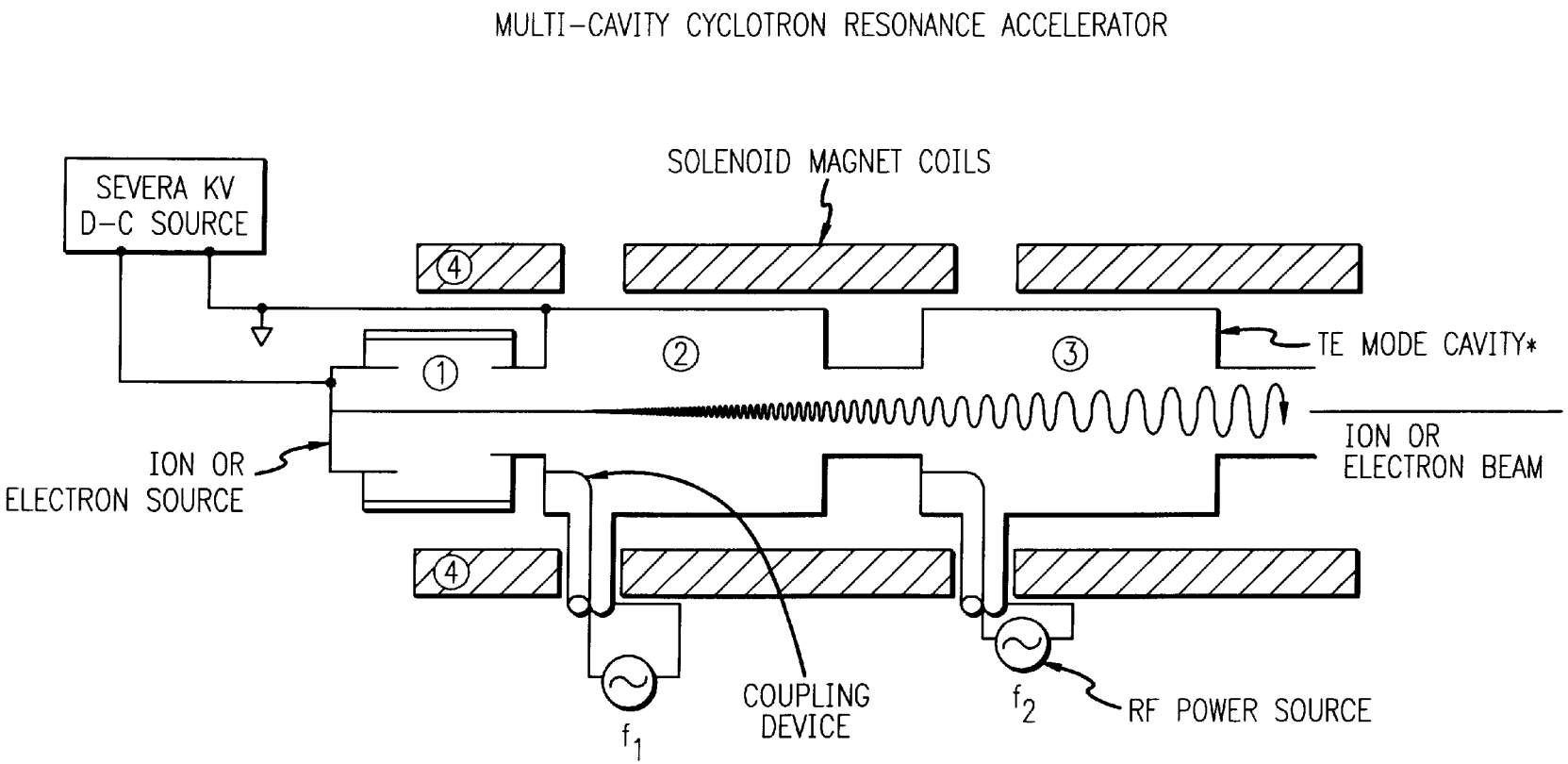
FIG. 1 illustrates two stages in multi-stage high-gradient cavity proton accelerator.

An exemplary RF structure of a multi-stage high-gradient cavity proton accelerator is illustrated in FIG. 1. The accelerator includes an ion source 1, end-to-end $TE_{111}$ rotating mode room-temperature cavities 2, 3, and a solenoid coil 4. Input feeds a and b are coupled to the cavities 2 and 3, respectively. The solenoid coil 4 provides the substantially uniform magnetic field that threads through the cavities 2 and 3. The magnetic field in the accelerator must be substantially uniform across all stages, since an increasing field would lead to an undesirable loss of axial momentum and stalling, while a decreasing field would lead to an unmanageable increase in the orbit radius of the charged particle. It should be appreciated that the accelerator shown in FIG. 1 is simplified for ease of explanation, and that an actual accelerator may have many more cavity stages than the two shown in the figure.

Referring back to FIG. 1, the first cavity 2 is driven with 10 MW of RF power at 100 MHz, and the second cavity 3 is driven with 7.7 MW at 94 MHz. It is important that successive cavity stages of the accelerator operate at successively-lower RF frequencies in order to maintain approximate resonance as the particle mass increases. Particle acceleration from 10 keV to 1 GeV requires an aggregate frequency reduction between the first and last cavity states of approximately a factor of two. This diminution in frequency is opposite to the temporally-increasing frequency variation typical for synchrotrons, where the magnetic field also increases.

In the current embodiment, the unloaded (i.e., ohmic and external) and beam-loaded quality factors for the first cavity are $Q_o$=100,000 and $Q_L$=30,000; while for the second cavity they are $Q_o$=100,000 and $Q_L$=17,000. These values imply that 70% of the incident RF power is absorbed by the proton beam in the first cavity 2, and 83% in the second cavity 3. The beam power after the second stage is 13.4 MW. A uniform magnetic field of 67.0 kG threads both cavities. The injected proton beam energy is 10 keV, the final proton energy is 114.0 MeV and the proton current is 117.6 mA. For purposes of this illustration, the beam is assumed to have zero initial emittance and zero initial energy spread. Sixteen computational particles to simulate the beam are injected at time intervals of 1.25 nsec, corresponding to RF phase intervals of $\pi/4$ over two cycles at 100 MHz and to a pulse width of 20 nsec. The injected particles have zero initial radial coordinate.

Figure 2:
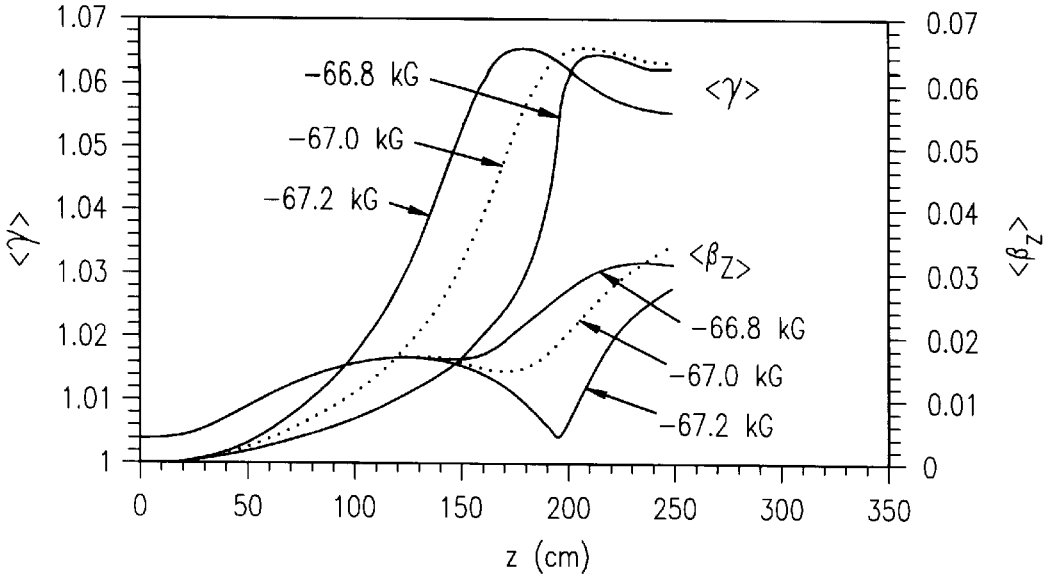
FIG. 2 illustrates the computed variations of mean proton energy.

The histories of average energy gain and axial velocity variation along the first cavity are shown in FIG. 2 for three values of axial guide magnetic field $B_z$=66.8, 67.0, and 67.2 kG. Computed variations of mean proton energy, in units of $(\gamma)=1+\overline{U}[\text{MeV}]/938$, and mean axial velocity $(\beta_z)=\overline{v}_z/c$, are illustrated as functions of axial coordinate z within the first cavity. Examples are shown for parameters as described in text, and for three values of the B-field. The first cavity has a radius of 110 cm and the energy gain at the end of the cavity (z=250 cm) is maximum for 67.0 kG, where the decrease in axial velocity within the cavity is not as severe as for the 67.2 kG case. Further increase in $B_z$ is found to lead to a reversal of the sign of axial velocity, i.e., to particle reflection. This stalling effect is attributable to a ponderomotive axial force, which evidently depends on the precise details of the proton orbit. For $B_z$=67.0 kG, a net energy gain $\overline{U}-\overline{U}_o$=59.5 MeV ($\gamma$=1.063) with only a small temporary decrease in axial velocity is found during passage through the cavity, where $\overline{U}$and $\overline{U}_o$ are the ensemble average final and initial proton energies, respectively. The small diminution in particle energy for z >200 cm is attributable to excessive phase slip, since the cyclotron frequency of the protons has fallen to below 94% of the RF frequency at this stage. The average acceleration gradient in the first cavity is 23.8 MeV/m. With a beam current of 117.6 mA, the efficiency of the first cavity is 70%. The strong axial acceleration gradient is possible since the protons make a large number of gyrations, and follow a long path moving nearly parallel to the rotating RF electric field. For this example, the protons execute about 48 turns in the first cavity, and reach a final gyration radius of about 17 cm. This rapid, efficient cyclotron resonance acceleration of protons in a $TE_{111}$ cavity with a uniform magnetic field is reminiscent of similar results reported for electrons by Jory and Trivelpiece, who showed evidence of acceleration by 100's of keV.

Figure 3A:
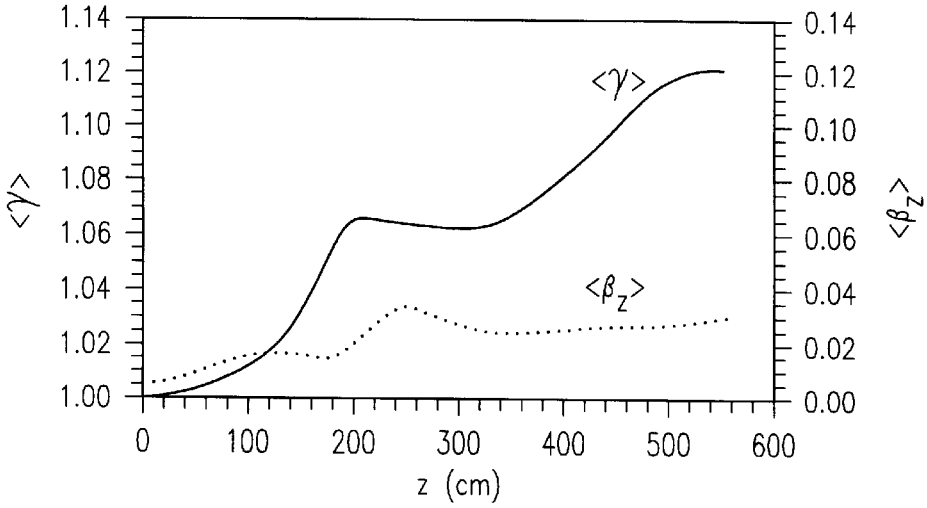
FIG. 3*a* illustrates the energy gain for protons in traversing two cavities.
Figure 3B:
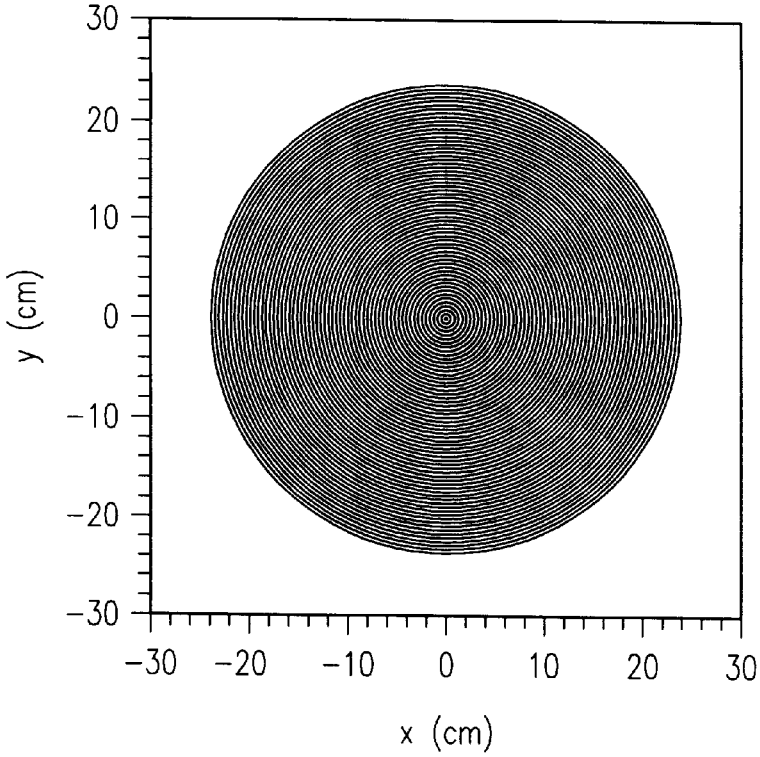
FIG. 3*b* illustrates the projection in the transverse plane of the orbit of a proton undergoing acceleration as in FIG. 3*a;*
Figure 3C:
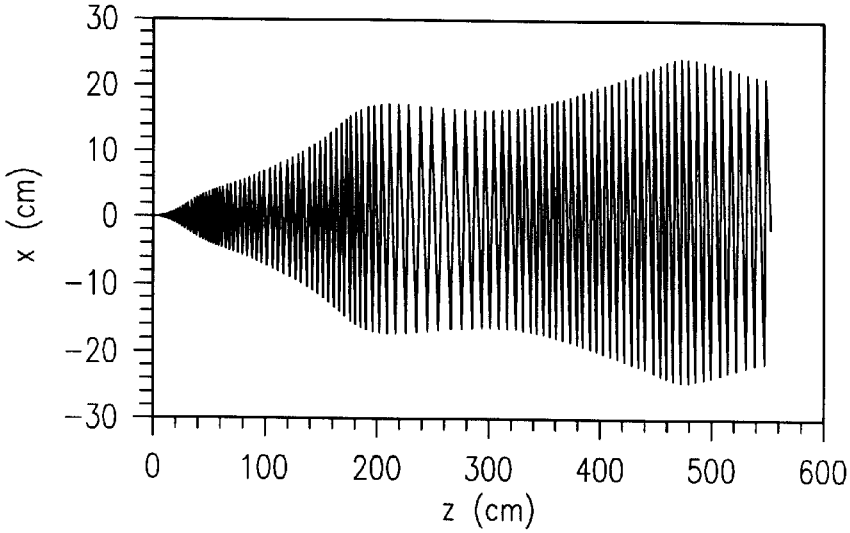
FIG. 3*c* illustrates the projection in a longitudinal plane of the orbit of a proton undergoing acceleration as in FIGS. 3*a* and 3*b;*

FIG. 3*a* shows the energy gain and axial velocity for two exemplary cavities operated in tandem. The second cavity, operating at 94 MHz, has a radius of 110 cm and a length of 302 cm. The relative phase difference between fields in the first and second cavities (reckoned at the initial time) is set at 0.70$\pi$, the value that was found to maximize energy gain in the second cavity. This phase difference allows gyrating protons to enter the second cavity with their velocity vectors aligned nearly parallel to the rotating RF electric field, for maximum energy gain. From FIG. 3*a*, it is seen that the energy gain in the two cavities together reaches 113.96 MeV ($\gamma$=1.1215), while the axial velocity remains sensibly constant throughout the second cavity. The beam-loaded Q (17,000) and RF drive power (7.7 MW) were adjusted to accommodate the same current (117.6 mA) as in the first cavity. The protons execute about 43 turns in the second cavity, and reach a final gyration radius of about 22 cm. The average acceleration gradient for both cavities is 20.7 MeV/m. FIGS. 3*b* and 3*c* show projections in the transverse (x-y) and longitudinal (x-z) planes of the orbit of a single proton during the course of its acceleration. Specifically, FIG. 3*b* illustrates a projection in the transverse plane of the orbit of a proton undergoing acceleration as in FIG. 3*a*. FIG. 3*c* illustrates a projection in the longitudinal plane of the orbit of a proton undergoing acceleration as in FIGS. 3*a* and 3*b*. The proton executes about 90 turns during acceleration.

Figure 4:
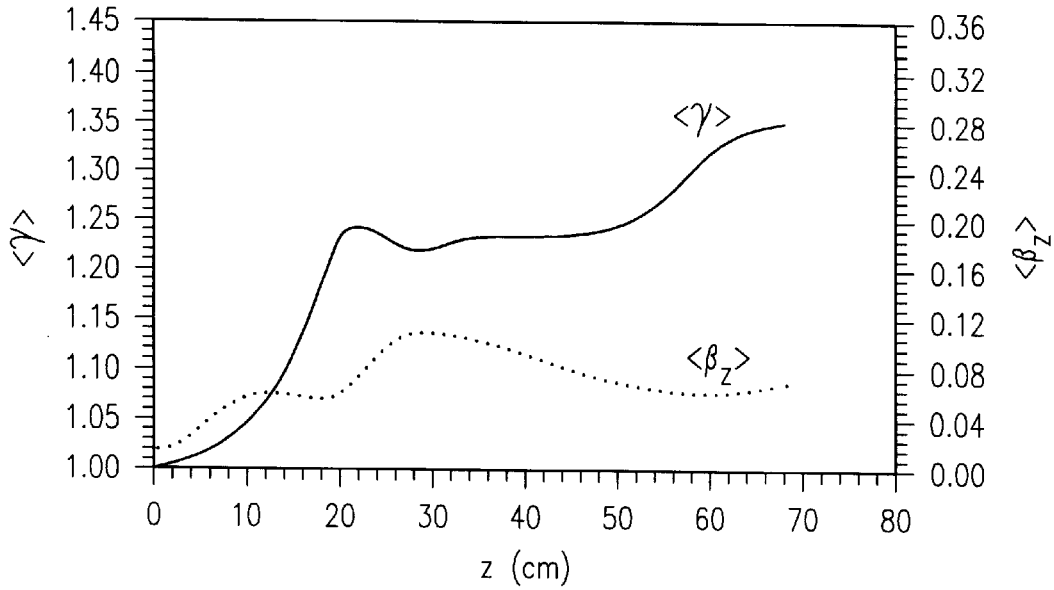
FIG. 4 illustrates the normalized mean energy and axial velocity for muons in a two-cavity cyclotron accelerator.

The same principle that is shown in the above example for acceleration of protons can also be applied to acceleration of other charged particles, namely electrons, muons, or heavy ions. In view of the current strong interest in muon accelerators, an alternative embodiment of the invention may provide muon acceleration at cyclotron resonance using cavities in a strong uniform magnetic field. FIG. 4 shows an example for two cavities in a uniform 67.0 kG B-field, for parameters as follows:

first cavity: f=850 MHz, P=10 MW, $Q_o$=40,000, $Q_L$=20,000, R=13 cm, L=29 cm;

second. cavity: f=700 MHz, P=4.0 MW, $Q_o$=40,000, $Q_L$=10,000, R=15 cm, L=39 cm.

Acceleration in the first cavity is from 10 keV to 23.24 MeV, and thence in the second cavity to 37.1 MeV. The beam current is 215 mA, maximum orbit radius is 3.8 cm, average acceleration gradient is 54.4 MeV/m, and overall efficiency is 57%. These values compare favorably with conventional muon linacs.

The 100 MHz and 94 MHz $TE_{111}$ cavities for the example of the first two stages of the proton accelerator shown in FIGS. 2–4 have diameters of 220 cm, yet the maximum proton orbit diameters are 34 and 44 cm. At least in these first stages, most of the cavity volume is not traversed by the proton beam, but is permeated with magnetic flux lines from the surrounding solenoid coils. The required 67 kG cryomagnet would need a room-temperature bore diameter of perhaps 240 cm (to allow room for the RF feeds, as sketched in FIG. 1. While this is probably within the present state-of-the-art, it would be highly desirable to reduce this bore diameter.

Figure 5:
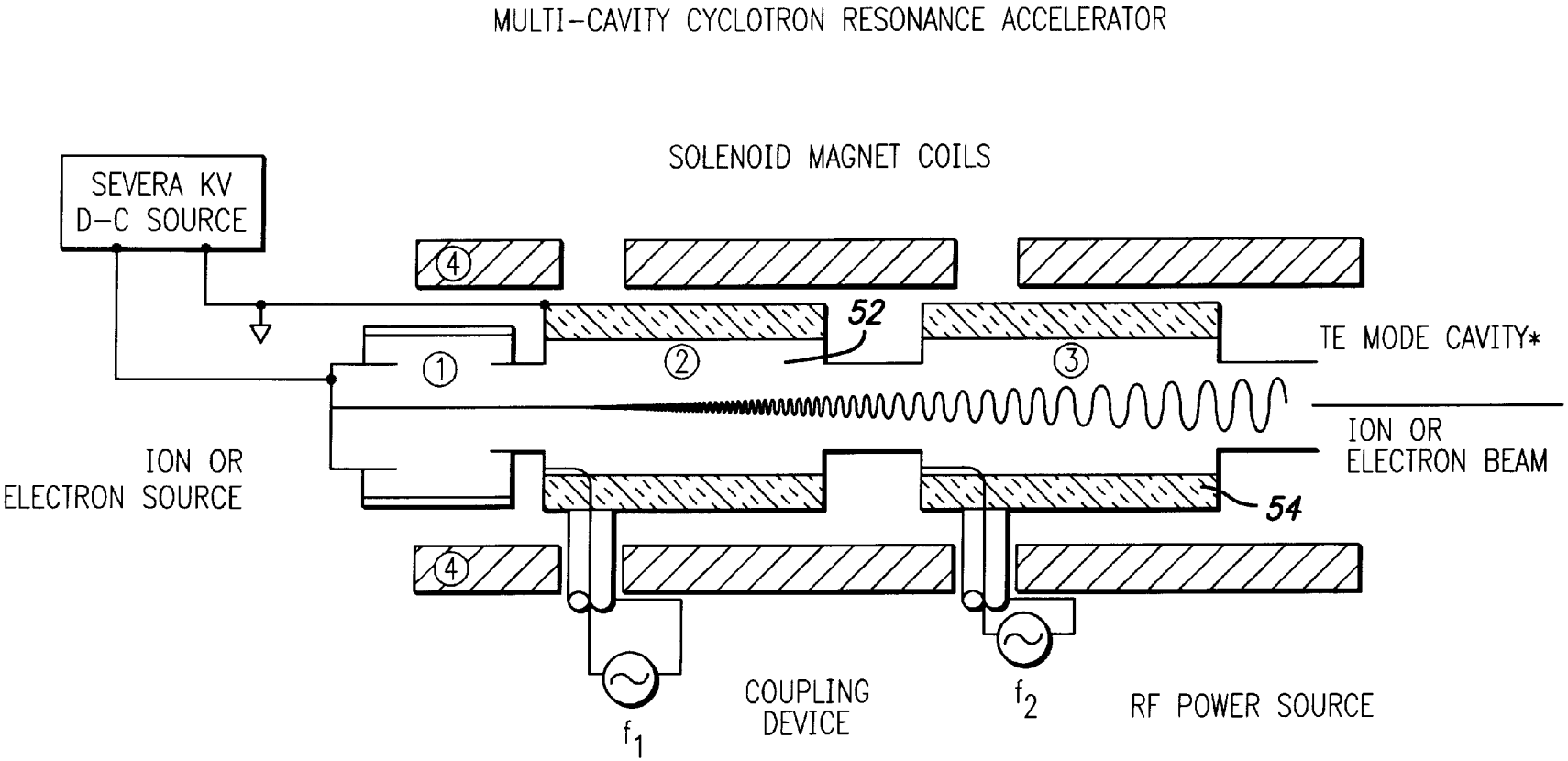
FIG. 5 illustrates an example of an accelerator with a coaxial dielectric liner.

In a first alternative embodiment, as shown in FIG. 5, the cavity diameters 52 are reduced by using dielectric loading in the form of a thick coaxial dielectric liner 54. Analysis of the dispersion relation for the $HEM_{11}$, mode showed, for example, that a 100 MHz cavity with $TE_{11}$-like fields in the interior vacuum hole could have a significantly reduced overall diameter. For alumina dielectric ($\epsilon$=9.6 ), and for a hole diameter of 40 cm and cavity length of 250 cm, the outer diameter would be about 84 cm. Successive cavities would of course be larger, as their resonant frequencies decrease and as their hole diameters increase to accommodate the increasing radius of the gyrating beam. However, the presence of alumina within a high-power cavity structure could lead to breakdown problems, not to mention the extreme weight and cost of such large alumina elements.

Figure 6:
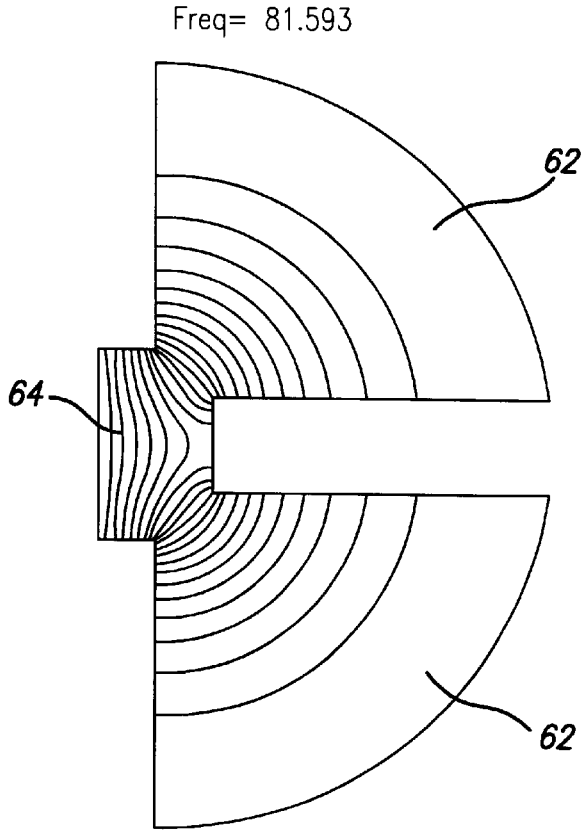
FIG. 6 illustrates an example of a cross-section of a four-vaned RFDD structure for a proton cyclotron accelerator.

In a second alternative embodiment, as shown in FIG. 6, thick radial vanes 62 are employed in the cavity 64 that provide capacitive loading and thereby reduce the cutoff frequency for the desired dipole modes. It should be noted that only one-half of the structure is shown in FIG. 6, after cutting along the vertical axis of symmetry. When four symmetric vanes are used, the two dipole modes are 90° out of time and spatial phase with one other. To obtain a rotating (i.e., circularly polarized) field, these two dipole modes are excited in time-quadrature. The structure can be labeled a radio-frequency double-dipole (RFDD). A simple example of a RFDD structure has been analyzed using HFSS structure simulation code; results are shown and incorporated in FIG. 6. It can be seen that the electric field lines for the dipole mode are seen to be nearly uniform near the axis.

For a RFDD structure as shown in FIG. 6, with an outer diameter of 130 cm, a ridge width of 15 cm, and a central gap between opposing ridges of 30 cm, the cutoff frequency for the dipole mode was found to be 73.7 MHz, while the cutoff frequency for the quadrupole mode was found to be 78.97 MHz. Thus, a section of RFDD structure 222 cm in length would have a dipole resonance frequency of 100 MHz and a quadrupole resonance frequency of 104 MHz. Operation with $Q_L$ of the order of 1,000–10,000 should thus be possible purely in the dipole mode, without significant coupling by the beam to the quadrupole mode. This idealized example is shown to illustrate the possibility of devising an all-metal structure for the cavities in the proton cyclotron accelerator that will have outer diameters significantly smaller than for simple $TE_{111}$, cylindrical cavities. It is anticipated that the analysis of RFDD structures be further refined, including optimizing the shape of the vanes, rounding of sharp corners to reduce surface field strengths and providing input coupling for excitation of both degenerate dipole modes in time quadrature. For an optimized design of a two-cavity structure based on RFDD, it is also intended to carry out proton acceleration studies in the actual RF fields of the structures using the particle-in-cell simulation code KARAT. Once an optimized structure is found a cold-test model will be built, scaled to S-band, for experimental tests to confirm the design.

Having thus described a preferred embodiment of a multi-cavity cyclotron resonance accelerator, it should be apparent to those skilled in the art that certain advantages over the prior art have been achieved. It should also be appreciated that various modifications, adaptations, and alternative embodiments thereof may be made within the scope and spirit of the present invention. The invention is further defined by the following claims.

What is claimed is:

1. A high-current, high-gradient, high-efficiency, multi-stage cavity cyclotron resonance accelerator (MCCRA) for accelerating charged particles, comprising:

a charged particle source for emitting said charged particles;

a plurality of successive rotating mode cavities extending in an axial direction and coupled to said charged particle source, wherein each successive cavity operates at a progressively-lower RF frequency to maintain approximate resonance of said charged particles; and at least one solenoid coil coaxially disposed about said cavities, said solenoid coil providing a substantially uniform magnetic field along an axial extent of said plurality of successive cavities.

2. The multi-stage cavity cyclotron resonance accelerator (MCCRA) of claim 1, further comprising a plurality of radial vanes disposed in at least one of said plurality of cavities.

3. The multi-stage cavity cyclotron resonance accelerator (MCCRA) of claim 2, wherein said plurality of radial vanes further comprise four radial vanes adapted to provide a radio-frequency double-dipole (RFDD).

4. The multi-stage cavity cyclotron resonance accelerator (MCCRA) of claim 1, wherein said charged particles are selected from a group consisting of ions, electrons, protons, and muons.

5. The multi-stage cavity cyclotron resonance accelerator (MCCRA) of claim 1, wherein each of said plurality of successive rotating mode cavities further comprises a room-temperature cavity.

6. The multi-stage cavity cyclotron resonance accelerator (MCCRA) of claim 5, wherein said charged particles are not focused into a small spot within said plurality of successive rotating mode cavities.

7. The multi-stage cavity cyclotron resonance accelerator (MCCRA) of claim 1, wherein each of said plurality of successive rotating mode cavities further comprises an accelerating cavity.

8. The multi-stage cavity cyclotron resonance accelerator (MCCRA) of claim 1, wherein each of said plurality of successive rotating mode cavities further comprises an RF cavity.

9. The multi-stage cavity cyclotron resonance accelerator (MCCRA) of claim 1, wherein each of said plurality of successive rotating mode cavities transfers an amount of RF energy to said charged particles.

10. The multi-stage cavity cyclotron resonance accelerator (MCCRA) of claim 1, wherein each of said plurality of successive rotating mode cavities further comprises a $TE_{111}$ mode cavity.

11. The multi-stage cavity cyclotron resonance accelerator (MCCRA) of claim 1, wherein said progressively-lower RF frequency is lower than a local relativistic cyclotron frequency of said charged particles traveling in said cavity operating said progressively-lower RF frequency.

12. The multi-stage cavity cyclotron resonance-accelerator (MCCRA) of claim 1, wherein said charged particles produce a cyclotron radiation as they are accelerated.

13. A method of accelerating charged particles, comprising the steps of:

emitting said charged particles from a charged particle source;

transmitting said charged particles in an axial direction through a plurality of successive rotating mode cavities extending in an axial direction, wherein each of said successive rotating mode cavities operates at a different RF frequency; and providing a substantially uniform magnetic field along an axial extent of said plurality of successive cavities.

14. The method of claim 13, further comprising the step of operating each successive cavity at a progressively-lower RF frequency to maintain approximate resonance of said charged particles.

15. The method of claim 13, further comprising the step of capacitively loading at least one of said plurality of cavities.

16. The method of claim 13, wherein said charged particles are selected from a group consisting of ions, electrons, protons, and muons.

17. A system for accelerating charged particles, comprising:

means for emitting said charged particles;

means for transmitting said charged particles in an axial direction through a plurality of successive rotating mode cavities extending in an axial direction, wherein each of said successive rotating mode cavities operates at a different RF frequency; and means for providing a substantially uniform magnetic field along an axial extent of said plurality of successive cavities.

18. The method of claim 13, further comprising the step of operating each successive cavity at a progressively-lower RF frequency to maintain approximate resonance of said charged particles.

19. The system of claim 17, further comprising means for reducing cutoff frequency for desired dipole modes.

20. The system of claim 17, wherein said charged particles are selected from a group consisting of ions, electrons, protons, and muons.

* * * * *